US005337648A

United States Patent [19]

Brage

[11] Patent Number: 5,337,648

[45] Date of Patent: Aug. 16, 1994

[54] COUNTERMASS FOR RECOILLESS WEAPONS

[75] Inventor: Anders N. Brage, Sollentuna, Sweden

[73] Assignee: Forsvarets Forskningsanstalt, Sundbyberg, Sweden

[21] Appl. No.: 916,104

[22] PCT Filed: Jan. 29, 1991

[86] PCT No.: PCT/SE91/00065

§ 371 Date: Jul. 29, 1992

§ 102(e) Date: Jul. 29, 1992

[87] PCT Pub. No.: WO91/11673

PCT Pub. Date: Aug. 8, 1991

[30] Foreign Application Priority Data

Jan. 29, 1990 [SE] Sweden ..... 9000303-9

[51] Int. Cl.[5] ..... F41A 1/10

[52] U.S. Cl. ..... 89/1.704; 89/1.701

[58] Field of Search ..... 89/1.7, 1.701, 1.702, 89/1.704, 1.706

[56] References Cited

U.S. PATENT DOCUMENTS

| | | | |
|---|---|---|---|
| 4,050,351 | 9/1977 | Stauff | 89/1.701 |
| 4,172,420 | 10/1979 | Voss et al. | 89/1.701 |
| 4,244,293 | 1/1981 | Grosswendt et al. | 89/1.701 |
| 4,574,680 | 3/1986 | Nicodemus | 89/1.701 |
| 4,643,071 | 2/1987 | Baechler et al. | 89/1.701 |

FOREIGN PATENT DOCUMENTS

| | | |
|---|---|---|
| 1453826 | 7/1969 | Fed. Rep. of Germany . |
| 408091 | 5/1979 | Sweden . |
| 233347 | 3/1926 | United Kingdom . |

*Primary Examiner*—David H. Brown

*Attorney, Agent, or Firm*—Jacobson, Price, Holman & Stern

[57] ABSTRACT

A countermass for a recoilless weapon which is intended to be placed behind the propellant charge of the weapon projectile and intended to depart together with the propellant gases that exit from the rearward end of the weapon when the projectile is projected forward. The countermass includes a plurality of mutually sequential and separated countermass bodies, each of which has a gas throughflow passage. The throughflow passage in the countermass bodies is sized to have a larger inlet area in bodies at the forward end of the countermass and gradually smaller inlet area in bodies at the rearward end of the countermass.

7 Claims, 2 Drawing Sheets

COUNTERMASS FOR RECOILLESS WEAPONS

BACKGROUND OF THE INVENTION

The invention relates to a countermass for so-called recoilless weapons of the kind which include a barrel which is open at both ends and which, when fired, produce a rearwardly directed impulse or thrust which counteracts the recoil forces engendered by the fired projectile. The countermass is positioned behind the propulsive charge and exits together with the rearwardly exiting propellant gases as the projectile is propelled forwards.

In order to obtain a recoilless weapon, an additional propellant charge has been place behind the projectile and the gas generated thereby is caused to be blown-out rearwardly through an outflow nozzle. This results in a rearwardly directed momentum which can be adapted so as to be equal to the forwardly directed momentum of the projectile. Such a so-called "backblast weapon" produces behind the weapon a pressure of such high magnitude that its effect on the operating personnel places limits on the capacity of the weapon concerned, i.e. on the weight and the muzzle velocity of the projectile used.

It is known to position a countermass behind the propulsive charge, in order to increase the rearwardly directed momentum and therewith increase the capacity of the weapon, without generating excessively high pressure behind the weapon. The countermass is intended to move rapidly rearwards in the barrel, and is normally constructed so that it is vapourized or pulverized behind the weapon. The countermass is normally accelerated as a rigid body in the barrel and then pulverized subsequent to its exit from the barrel. One drawback with known countermass weapons, however, is that they are either too heavy or generate an excessive high risk zone behind the weapon. Compared with existing rocket-type "backblast weapons", the gains have been small both with regard to the effectiveness of the weapon and with regard to the negative effect that the pressure has on the operating personnel.

It is possible to extend the acceleration path of the projectile, so as to increase the muzzle velocity of a given projectile without increasing the size of the propellant charge at the same time. However, this requires a similar extension of the countermass acceleration, or requires the weight of said countermass to be considerably increased. Each increase in the length of the weapon or its weight has a limiting effect on the ease with which the weapon can be handled, and earlier attempts to improve the capacity of recoilless weapons have often resulted in excessively bulky weapons. Weapons whose capacity has been improved by increasing the maximum pressure in the barrel have also resulted in a heavier weapon, since this improvement requires heavy dimensioning of the barrel.

SUMMARY OF THE INVENTION

One object of the present invention is to provide a countermass which will enable the capacity of the weapon to be improved while avoiding the aforesaid drawbacks.

According to the invention, the countermass includes a plurality of mutually sequential and mutually separate countermass bodies, each of which is provided with at least one throughflow passage through which propellant gases can pass. The passage is adapted to the countermass body concerned and is positioned in the countermass so that, when firing the weapon, the countermass bodies will be accelerated consecutively by the exiting propellant gases beginning from the rear. Thus, the time taken for the countermass and the gases to exit through the rear end of the barrel is longer than when a conventional countermass is used.

During firing of the weapon, the highest pressure drop and the greatest acceleration occur on that countermass body which is located furthest to the rear in the barrel at any moment in time. The pressure drop is determined by the configuration and throughflow area of the passage.

The inventive countermass results in reduced maximum pressure in the combustion chamber and, at the same time, a longer duration of relatively high pressure in the barrel. This enables the capacity of the weapon to be increased in comparison with earlier known recoilless weapons, without increasing the weight of the weapon. Alternatively, the weight of the weapon can be decreased while retaining the capacity of the weapon. Furthermore, in the case of a weapon equipped with the novel countermass, the gases exiting through the rear end of the barrel are extended in time, which reduces the effect of pressure on the surroundings and on the operating personnel. The throughflow passage may be configured in many different ways, such as to provide the highest pressure drop across that countermass body which is located furthest to the rear in the barrel at that moment in time. The pressure which accelerates the countermass body is built-up in front of the narrowest section of the throughflow passage. By providing the countermass with a throughflow passage which becomes narrower in respective countermass bodies the further rearwardly said bodies are located in the countermass, it is therefore possible to accelerate the countermass bodies consecutively. The throughflow passage preferably has the form of an axially extending passage placed centrally in respective bodies and the inlet area of which decreases progressively from body to body. Furthermore, the throughflow passage may have the form of a rearwardly widening nozzle within each individual countermass body. The nozzle form may also be different with different countermass bodies.

According to one preferred embodiment of the invention, the throughflow passage is a central passage which widens rearwardly in nozzle form, within the individual countermass body concerned, and the inlet area of which decreases progressively from body to body rearwardly in the countermass. This construction has been found to provide an extremely good pressure-regulating function. The nozzle configuration also functions to reduce the acceleration forces acting on the countermass body.

By giving the throughflow passage the form of an expanding nozzle, there is afforded the additional advantage that the acceleration force will engage or attack the leading surface of the countermass body (the part facing towards the combustion chamber) which represents the narrowest section of the individual countermass body. This will ensure that the total mass of the countermass body will be accelerated by a propelling force in an anticipatable manner, which is essential, among other things, to the pressure control which results from the deformation of the body, as described herebelow. If the throughflow passage is given another shape, for instance the shape of a cylindrical bore, minor variations in the shape of the passage, the passage surfaces, etc., can cause the accelerating force to engage other parts of the body and to rupture or fracture the body in an uncontrolled fashion.

Part of the rearwardly directed impulse can be obtained by continuously dispersing countermass material and accelerating the dispersed material to a very high velocity in the propellant gases that exit through the throughflow passage during a firing sequence. Although this will result in a tendency for the throughflow passage to expand, this tendency can be counteracted by ensuring that the countermass body will deform at the pressure and temperature prevailing in the barrel when the projectile is fired. The countermass body will then be compressed by the forces of inertial prevailing during acceleration in the barrel and material will be redistributed towards the throughflow passage. Increased throttling of the gas throughflow can also be obtained in this way when the countermass body is greatly accelerated, which advantageously contributes to prolonging the pressure in the barrel.

The invention will now be described in more detail with reference to the accompanying drawings.

DETAILED DESCRIPTION OF THE DRAWINGS

Figure 1A:
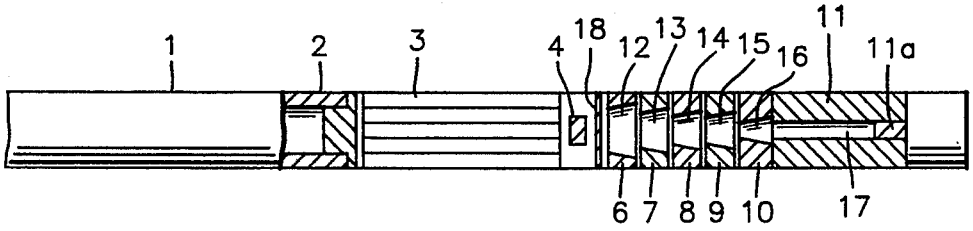
FIG. 1*a* are longitudinal sectioned views of one embodiment of an inventive countermass positioned in a schematically illustrated barrel of a recoilless weapon.

FIG. 1 illustrates the barrel 1 of a recoilless weapon. Other weapon components, such as the firing mechanism, handle, sights, etc. have been omitted from the illustration. The reference numeral 2 identifies the weapon projectile, 3 identifies its propellant charge, 4 identifies an igniting charge and 5 identifies an inventive countermass. In the illustrated embodiment, the countermass comprises six mutually sequential countermass bodies 6–11, each of which is provided with a respective centrally located, axially extending throughflow passage 12–17. The inlet area of each passage is greatest for the furthest forward countermass body 6 and thereafter decreases with each of the subsequent countermass bodies. The throughflow passage in the first five bodies also widens rearwardly in the form of a nozzle within each individual countermass body. The countermass body 11 located furthest to the rear has a straight-cylindrical passage and also a greater mass than any of the forwardly lying bodies 6–10.

A sealing plate 18 is mounted forwardly of the countermass. A corresponding sealing plate may also be mounted rearwardly of said mass. Alternatively, the passage 17 in the body 11 may be blocked initially by a mass 11*a* or the like which is blown from said body subsequent to being acted upon by pressure over a given time period or when a predetermined pressure prevails in the barrel during the .initial stage of a firing sequence.

The countermass bodies are constructed from a material which will deform as the body accelerates in the barrel during firing of the projectile. This material will then be redistributed towards the throughflow passage, for instance by plastic flow when the material concerned is given plastic properties or as a result of propagation collapse due to the shear forces acting thereon, when the material is given the free-flowing properties of a weakly bonded powder mass. The countermass body can be caused to reduce the cross-sectional area of the throughflow passage in this way when the body is powerfully accelerated.

With regard to the risk zone created behind the weapon, it is appropriate to compose the countermass bodies of a bonded powdered mass which will disintegrate rapidly when exiting from the barrel.

According to one preferred embodiment of the invention, the countermass bodies are composed of a relatively weakly bonded powdered mass. Such bodies have been found to provide advantageous properties, both with regard to the pressure-regulating function of the body during its residence time in the barrel and also with regard to rapid and complete disintegration of the body upon its exit from the barrel. In this case, the material comprises a powdered ballast material of given grain-size distribution and particle form, and a binder. The countermass body may comprise a mixture of different types of powder.

The grain-size distribution, the grain form and the binder content are chosen so that the ultimate countermass body will have a porosity of 30–70%. A porosity of 45–55% is particularly preferred when a small risk zone behind the weapon is desired.

The porous structure has been found to cause those countermass parts which leave the barrel without having been earlier dispersed in the propellant gases to fragmentize very quickly and completely upon exiting from the barrel, and are therewith to slow down quickly in the ambient air. One contributory reason is that the porous structure of the bodies is pressurized by the gas pressure prevailing in the barrel. The fine-grain powder/gas cloud formed by these bodies behind the barrel also has an effective damping effect on the shockwave travelling from the rear end of the barrel.

The ballast material may, for instance, be silicate mineral, metal powder, gypsum, barium sulphate and heavy materials containing tungsten, copper, iron, etc. The grain size should be smaller than 2 mm in diameter, so that the powder will be retarded rapidly in the ambient air when exiting from the barrel, and greater than 0.05 mm, in order for the material to disintegrate.

The proportion of binder used is preferably from 1–10% by weight, calculated on the ballast material, and may consist of sugar, thermosetting resin, glue, Portland cement or gypsum, for instance. Particularly good results have been obtained with a phenol resin binder, in which case the binder content was about 5% of the weight of the ballast material.

The countermass bodies can be produced by first mixing the powder with the binder and then compressing or moulding the powder/binder mixture in a mould.

Figure 2A:
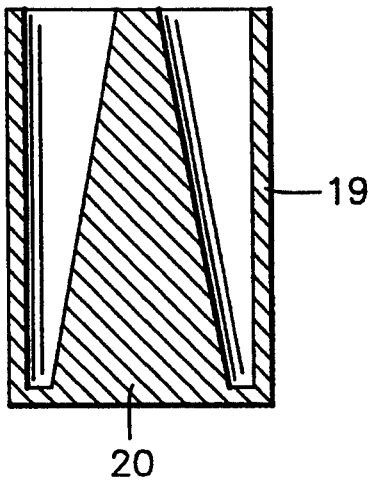
FIGS. 2*a*–2*c* illustrate a method of manufacturing an inventive countermass.
Figure 2B:
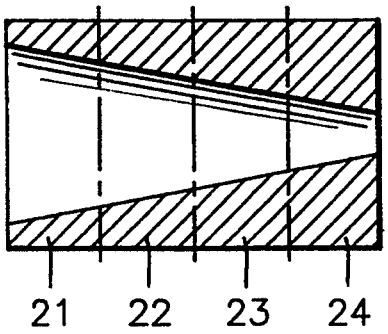
Figure 2C:
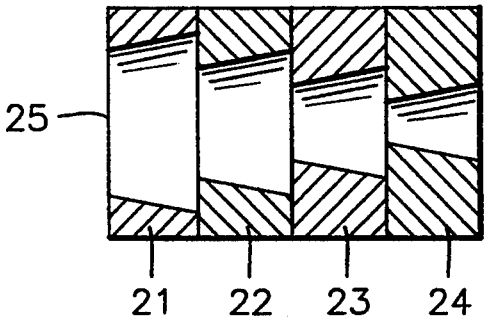

FIG. 2*a* illustrates an embodiment of one such mould 19 intended for producing a countermass element, which in the illustrated case is intended to be subsequently divided into a plurality of countermass bodies. Several such countermass elements in which the throughflow passage has mutually different forms and which also consists of different materials may be included in the construction of the ultimate countermass mounted in the weapon. The mould 19 has an inner diameter which corresponds to the diameter of the barrel of the weapon concerned and a central, conical element 20 which provides a nozzle-like throughflow passage in the bodies. Powder having a given grain-size distribution is mixed with, for instance, powdered phenol resin, and compacted in the mould 19 by shaking the mould, and then heat hardened or cured. The thus produced countermass element can then be divided into a number of countermass bodies 21–24, as shown in FIG. 2*b*. Each of these countermass bodies is then turned, so as to obtain the configuration shown in FIG. 2*c*. In this way, each countermass body will obtain a nozzle-like throughflow passage whose inlet orifice 25 decreases in area from body to body rearwardly in the countermass element.

The manner in which the countermass functions will now be described in more detail with reference to FIGS. 1*a*–1*g*, of which FIGS. 1*b*–*g* illustrate the conditions that prevail in the barrel during different points of time in a weapon firing sequence. FIG. 1*a* illustrates the conditions prior to firing the weapon and have already been described in the aforegoing.

Figure 1B:
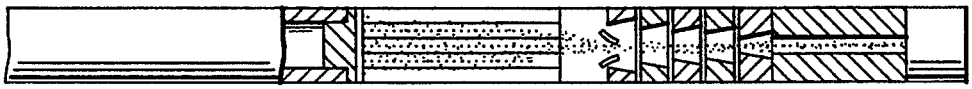
FIGS. 1*b*–1*g* illustrate the behaviour of the countermass during various stages of a firing sequence.

FIG. 1*b* illustrates the initial firing stage, in which the igniting charge 4 has ignited the propellant charge 3 and the gas pressure has increased to a value at which the sealing plate 18 located in front of the countermass ruptures.

Figure 1C:
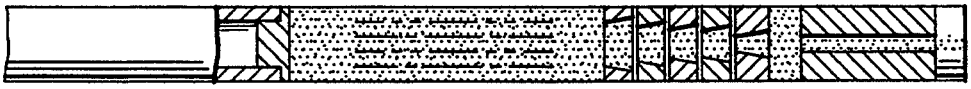

FIG. 1*c* illustrates the conditions that prevail when the propellant charge is fully ignited. The combustion gases fill the cavities or pores in the countermass and the pressure in the barrel has begun to accelerate the projectile 2 and also the countermass body 11 located furthest to the rear in the barrel. At the same time, propellant gases exit through the throughflow orifice 17, therewith lowering the pressure maximum in the combustion chamber. Small parts of material from the countermass are constantly dispersed in the exiting gas and are accelerated to high velocities.

Figure 1D:
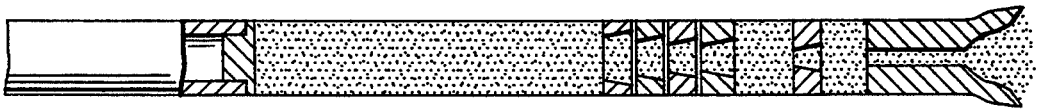

FIG. 1*d* illustrates the instance where the combustion gases continue to accelerate the projectile and the countermass body 11. The distance between the body 11 and the forwardly located body 10 has increased. The body 10 has now begun to accelerate as a result of the forces engendered by the pressure difference across said body. During this acceleration, the body 10 is compressed and countermass material is delivered to the throughflow passage 16, thereby increasing the throttling effect on the gas throughflow. The Figure also shows disintegration of the body 11 upon its exit from the barrel, the internal gas pressure in the throughflow passage 17 contributing to rapid disintegration of said body.

Figure 1E:
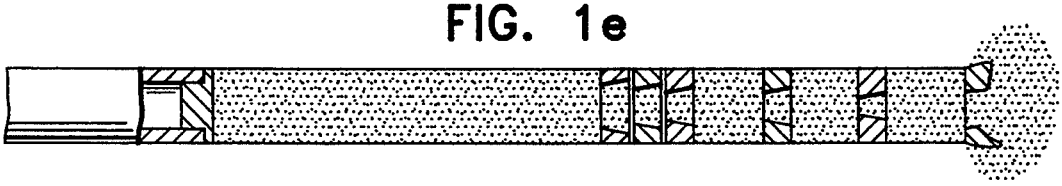
Figure 1F:
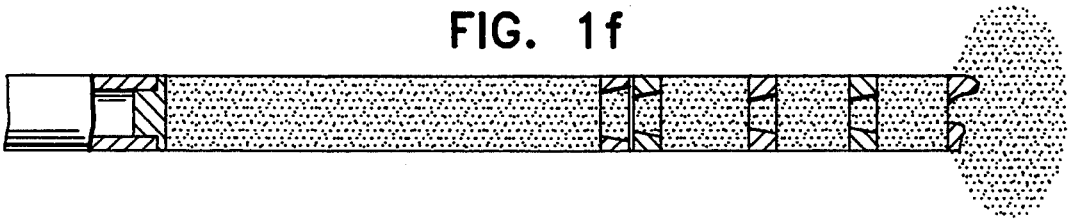
Figure 1G:
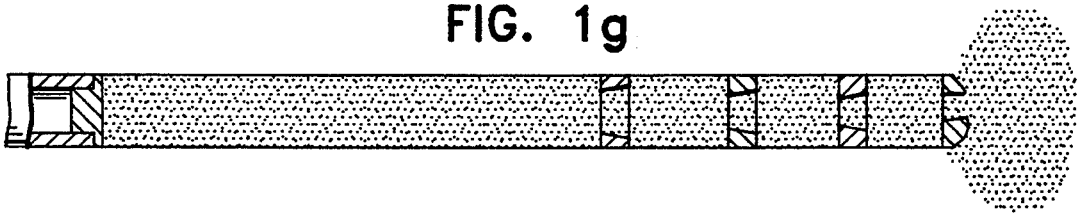

FIGS. 1*e*–1*g* illustrate the repetitive action that a countermass body, to the right in the illustration, reaches a given velocity before the nearest, forwardly lying countermass body (to the left thereof) begins to accelerate. At the same time, an earlier accelerated countermass body is disintegrated at the rear end of the barrel. The time taken for the countermass to exit from the barrel is thus prolonged and the bodies exit successively during acceleration of the projectile in the barrel.

The consecutive acceleration sequence of the countermass bodies enables a relatively high gas pressure to be maintained in the barrel over a longer period of time than when using a conventional countermass. The countermass can be said to function as an overpressure valve which lowers the brief maximum pressure and extends the duration of the pressure in the barrel. This enables the capacity of the weapon to be increased without needing to dimension the barrel more powerfully.

Because the gas flow through the rear end of the weapon is extended in time, the effect of pressure on the surroundings and the operating personnel is also decreased and the shockwave travelling rearwardly of the barrel is also dampened by the dust cloud generated behind the barrel, this dust cloud being augmented with disintegrated countermass material over an extended time period.

I claim:

1. A countermass for a recoilless weapon of the type for launching a projectile with a projectile propelling charge through a barrel which is open at both ends, the countermass intended to be positioned behind the projectile propelling charge and which is also intended to depart with propellant gases that exit rearwardly from the weapon when the projectile is propelled forwards, the countermass comprising:

a plurality of mutually sequentially arranged, separate countermass bodies extending between a forward end and a rearward end of the countermass, each of said countermass bodies having at least one gas throughflow passage, and the throughflow passage of each countermass body having a gas inlet area, the gas inlet area being widest for the countermass body located at the forward end of the countermass and the gas inlet area of the countermass bodies being gradually narrower from body to body towards the rearward end of the countermass.

2. A countermass according to claim 1, wherein the throughflow passage in the countermass body which is located furthest to the rearward end of the countermass is initially blocked and is intended to be blown clear during the initial stage of a firing sequence.

3. A countermass according to claim 1, wherein the throughflow passage is an axially extending passage located centrally in the countermass body.

4. A countermass according to claim 3, wherein the throughflow passage of at least the countermass body located at the forward end of the countermass widens rearwardly in the shape of a nozzle.

5. A countermass according to claim 1, wherein the countermass bodies are composed of a relatively weakly-bonded powder mass.

6. A countermass according to claim 5, wherein the countermass bodies have a porosity of 30–70%.

7. The countermass according to claim 6, wherein the countermass bodies have a porosity of 45%–55%.

* * * * *